US007147730B2

(12) United States Patent
Nakamura et al.

(10) Patent No.: US 7,147,730 B2
(45) Date of Patent: Dec. 12, 2006

(54) HIGH CARBON STEEL AND PRODUCTION METHOD THEREOF

(75) Inventors: Nobuyuki Nakamura, Fukuyama (JP); Takeshi Fujita, Fukuyama (JP); Katsutoshi Ito, Fukuyama (JP); Yasuyuki Takada, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 148 days.

(21) Appl. No.: 10/665,865

(22) Filed: Sep. 19, 2003

(65) Prior Publication Data

US 2004/0123924 A1 Jul. 1, 2004

Related U.S. Application Data

(60) Division of application No. 09/961,843, filed on Sep. 24, 2001, now Pat. No. 6,652,671, which is a continuation of application No. PCT/JP01/00404, filed on Jan. 23, 2001.

(30) Foreign Application Priority Data

Jan. 27, 2000 (JP) ..... 2000-018280

(51) Int. Cl.
*C21D 8/02* (2006.01)

(52) U.S. Cl. ..... 148/541; 148/603; 148/651

(58) Field of Classification Search ..... 148/603, 148/651, 653, 659, 661, 541, 547
See application file for complete search history.

(56) References Cited

U.S. PATENT DOCUMENTS 5,156,691 A * 10/1992 Hollenberg et al. ..... 148/663
6,673,171 B1 * 1/2004 Hlady et al. ..... 148/603

FOREIGN PATENT DOCUMENTS

| | | | |
|---|---|---|---|
| JP | 403044422 | * | 2/1991 |
| JP | 5-9588 | A | 1/1993 |
| JP | 5-98388 | A | 4/1993 |
| JP | 6-271935 | A | 9/1994 |
| JP | 409087805 | * | 3/1997 |
| JP | 52-47512 | A | 4/1997 |
| JP | 10-152757 | A | 6/1998 |
| JP | 2000-328172 | A | 11/2000 |

OTHER PUBLICATIONS

Patent Abstracts of Japan, vol. 018, No. 686 (C-1292), Dec. 26, 1994 of JP 06 271935 A ( Nippon Steel Corp), Sep. 27, 1994.

(Continued)

*Primary Examiner*—George Wyszomierski
(74) *Attorney, Agent, or Firm*—Frishauf, Holtz, Goodman & Chick, P.C.

(57) ABSTRACT

To provide a high carbon steel sheet having excellent hardenability and toughness, and low planar anisotropy of tensile properties affecting workability, and a method of producing the same.

A high car steel sheet having chemical composition specified by JIS G 4051 (Carbon steels for machine structural use), JIS G 4401 (Carbon tool steels) or JIS G 4802 (Cold-rolled steel strips for springs), wherein more than 50 carbides having a diameter of 1.5 μm or larger exist in 2500 $\mu m^2$, the ratio of number of carbides having a diameter of 0.6 μm or less with respect to all the carbides is 80% or more, and the Δr is more than −0.15 to less than 0.15, herein Δr=(r0+r90−2×r45)/4, and r0, r45, and r90 shows a r-value of the directions of 0° (L), 45° (S) and 90° (C) with respect to the rolling direction respectively.

3 Claims, 4 Drawing Sheets

○ : Δmax < 0.2

△ : 0.2 ≦ Δmax < 0.4

× : 0.4 ≦ Δmax

OTHER PUBLICATIONS

Patent Abstracts of Japan, vol. 1997, No. 01, Jan. 31, 1997 of JP 08 246051 A (Sumitomo Metal Ind Ltd), Sep. 24, 1996.
Patent Abstracts of Japan, vol. 016, No. 383 (C-0974), Aug. 17, 1992 of JP 04 124216 A (Sumitomo Metal Ind Ltd), Apr. 24, 1992.
Patent Abstracts of Japan, vol. 1996, No. 09, Sep. 30, 1996 of JP 08 120405 A (Sumitomo Metal Ind Ltd), May 14, 1996.
Fukui et al, "Formable High Carbon Cold Rolled Steel Sheet Utilizing Graphitization of Cementite", Report of the ISIJ Meeting of Current Advances in Materials and Processes, vol. 1 (1988), p. 1729, Published by The Iron and Steel Institute of Japan (with English language translation).
JIS G 4051 (1979).
JIS G 4401 (1983).
JIS G 4802 (1983).
JIS G 4802:1999 (1999).
JIS G 4401:2000 (2000).

* cited by examiner

Maximum diameter Dmax ($\mu$m) of carbide when 80 % or more is the ratio of number of carbides having diameter $\leqq$ Dmax with respect to all the carbides Number of carbides having a diameter of 1.5 μm or larger which exist in 2500 $\mu m^2$ of observation field area of electron microscope ○ : Δmax < 0.2

△ : 0.2 ≦ Δmax < 0.4

× : 0.4 ≦ Δmax

○ : Δmax < 0.15

△ : 0.15 ≦ Δmax < 0.35

× : 0.35 ≦ Δmax

HIGH CARBON STEEL AND PRODUCTION METHOD THEREOF

This application is a divisional application of application Ser. No. 09/961,843 filed Sep. 24, 2001 now U.S. Pat. No. 6,652,671, which is a continuation application of International Application PCT/JP01/00404 filed Jan. 23, 2001.

TECHNICAL FIELD

The present invention relates to a high carbon steel sheet having chemical composition specified by JIS G 4051 (Carbon steels for machine structural use), JIS G 4401 (Carbon tool steels) or JIS G 4802 (Cold-rolled steel strips for springs), and in particular to a high carbon steel sheet having excellent hardenability and toughness, and workability with a high dimensional precision, and a method of producing the same.

BACKGROUND ART

High carbon steel sheets having chemical compositions specified by JIS G 4051, JIS G 4401 or JIS G 4802 have conventionally much often been applied to parts for machine structural use such as washers, chains or the like. Such high carbon steel sheets have accordingly been demanded to have good hardenability, and recently not only the good hardenability after quenching treatment but also low temperature—short time of quenching treatment for cost down and high toughness after quenching treatment for safety during services. In addition, since the high carbon steel sheets have large planar anisotropy of mechanical properties caused by production process such as hot rolling, annealing and cold rolling, it has been difficult to apply the high carbon steel sheets to parts as gears which are conventionally produced by casting or forging, and demanded to have workability with a high dimensional precision.

Therefore, for improving the hardenability and the toughness of the high carbon steel sheets, and reducing their planar anisotropy of mechanical properties, the following methods have been proposed.

(1) JP-A-5-9588, (the term "JP-A" referred to herein signifies "Unexamined Japanese Patent Publication") (Prior Art 1): hot rolling, cooling down to 20 to 500° C. at a rate of 10° C./sec or higher, reheating for a short time, and coiling so as to accelerate spheroidization of carbides for improving the hardenability.

(2) JP-AP-5-98388 (Prior Art 2): adding Nb and Ti to high carbon steels containing 0.30 to 0.70% of C so as to form carbonitrides for restraining austenite grain growth and improving the toughness.

(3) "Material and Process", vol. 1 (1988), p. 1729 (Prior Art 3): hot rolling a high carbon steel containing 0.65% of C, cold rolling at a reduction rate of 50%, batch annealing at 650° C. for 24 hr, subjecting to secondary cold rolling at a reduction rate of 65%, and secondary batch annealing at 680° C. for 24 hr for improving the workability; otherwise adjusting the chemical composition of a high carbon steel containing 0.65% of C, repeating the rolling and the annealing as above mentioned so as to graphitize cementites for improving the workability and reducing the planar anisotropy of r-value.

(4) JP-A-10-152757 (Prior Art 4): adjusting contents of C, Si, Mn, P, Cr, Ni, Mo, V, Ti and Al, decreasing S content below 0.002 wt %, so that 6 μm or less is the average length of sulfide based non metallic inclusions narrowly elongated in the rolling direction, and 80% or more of all the inclusions are the inclusions whose length in the rolling directions is 4 μm or less, whereby the planar anisotropy of toughness and ductility is made small.

(5) JP-A-6-271935 (Prior Art 5), hot rolling, at Ar3 transformation point or higher, a steel whose contents of C, Si, Mn, Cr, Mo, Ni, B and Al were adjusted, cooling at a rate of 30° C./sec or higher, coiling at 550 to 700° C., descaling, primarily annealing at 600 to 680° C., cold rolling at a reduction rate of 40% or more, secondarily annealing at 600 to 680° C., and temper rolling so as to reduce the planar shape anisotropy caused by quenching treatment.

However, there are following problems in the above mentioned prior arts.

Prior Art 1: Although reheating for a short time, followed by coiling, a treating time for spheroidizing carbides is very short, and the spheroidization of carbides is insufficient so that the good hardenability might not be probably sometimes provided. Further, for reheating for a short time until coiling after cooling, a rapidly heating apparatus such as an electrically conductive heater is needed, resulting in an increase of production cost.

Prior Art 2: Because of adding expensive Nb and Ti, the production cost is increased.

Prior Art 3: $\Delta r=(r0+r\pi-2\times r45)/4$ is −0.47, which is a parameter of planar anisotropy of r-value (r0, r45, and r90 shows a r-value of the directions of 0° (L), 45° (S) and 90° (C) with respect to the rolling direction respectively). Δmax of r-value being a difference between the maximum value and the minimum value among r0, r45, and r90 is 1.17. Since the Δr and the Δmax of r-value are high, it is difficult to carry out a forming with a high dimensional precision.

Besides, by graphitizing the cementites, the Δr decreases to 0.34 and the Δmax of r-value decreases to 0.85, but the forming could not be carried out with a high dimensional precision. In case graphitizing, since a dissolving speed of graphites into austenite phase is slow, the hardenability is remarkably degraded.

Prior Art 4: The planar anisotropy caused by inclusions is decreased, but the forming could not be always carried out with a high dimensional precision.

Prior Art 5: Poor shaping caused by quenching treatment could be improved, but the forming could not be always carried out with a high dimensional precision.

DISCLOSURE OF THE INVENTION

The present invention has been realized to solve above these problems, and it is an object of the invention to provide a high carbon steel sheet having excellent hardenability and toughness, and workability with a high dimensional precision, and a method of producing the same.

The present object could be accomplished by a high carbon steel sheet having chemical composition specified by JIS G 4051, JIS G 4401 or JIS G 4802, in which the ratio of number of carbides having a diameter of 0.6 μm or less with respect to all the carbides is 80% or more, more than 50 carbides having a diameter of 1.5 μm or larger exist in 2500 $\mu m^2$ of observation field area of electron microscope, and the Δr being a parameter of planar anisotropy of r-value is more than −0.15 to less than 0.15.

The above mentioned high carbon steel sheet can be produced by a method comprising the steps of: hot rolling a steel having chemical composition specified by JIS G 4051, JIS G 4401 or JIS G 4802, coiling the hot rolled steel sheet at 520 to 600° C., descaling the coiled steel sheet, primarily annealing the descaled steel sheet at 640 to 690° C. for 20 hr or longer, cold rolling the annealed steel sheet at a reduction rate of 50% or more, and secondarily annealing the cold rolled steel sheet at 620 to 680° C.

The JIS G standards JIS G 4051 (1979), JIS G 4401:2000 and JIS G 4802:1999 and particularly the section of each disclosing the chemical composition, are hereby incorporated by reference.

EMBODIMENTS OF THE INVENTION

As to the high carbon steel sheet containing chemical composition specified by JIS G 4051, JIS G 4401 or JIS G 4802, we investigated the hardenability, the toughness and the dimensional precision when forming, and found that the existing condition of carbides precipitated in steel was a governing factor over the hardenability and the toughness, while the planar anisotropy of r-value was so over the dimensional precision when forming, and in particular for providing an enough dimensional precision when forming, the planar anisotropy of r-value should be made smaller than that of the prior art. The details will be explained as follows.

(i) Hardenability and toughness

By making a steel having, by wt %, C: 0.36%, Si: 0.20%, Mn: 0.75%, P: 0.011%, S: 0.002% and Al: 0.020%, hot rolling at a finishing temperature of 850° C., coiling at a coiling temperature of 560° C., pickling, primarily annealing at 640 to 690° C. for 40 hr, cold rolling at a reduction rate of 60%, and secondarily annealing at 610 to 690° C. for 40 hr, steel sheets were produced. Cutting out samples of 50×100 mm from the produced steel sheets, and heating at 820° C. for 10 sec, followed by quenching into oil at around 20° C., the hardness was measured and carbides were observed by an electron microscope.

The hardness was averaged over 10 measurements by Rockwell C Scale (HRc). If the average HRc is 50 or more, it may be judged that the good hardenability is provided.

The carbides were observed using a scanning electron microscope at 1500 to 5000 magnifications after polishing the cross section in a thickness direction of the steel sheet and etching it with a picral. Further, measurements were made on the size and the number of carbides in an observation field area of 2500 $\mu m^2$. The reason for preparing the observing field area of 2500 $\mu m^2$ was that if an observing field area was smaller than this, the number of observable carbides was small, and the size and the number of carbides could not be measured precisely.

Figure 1:
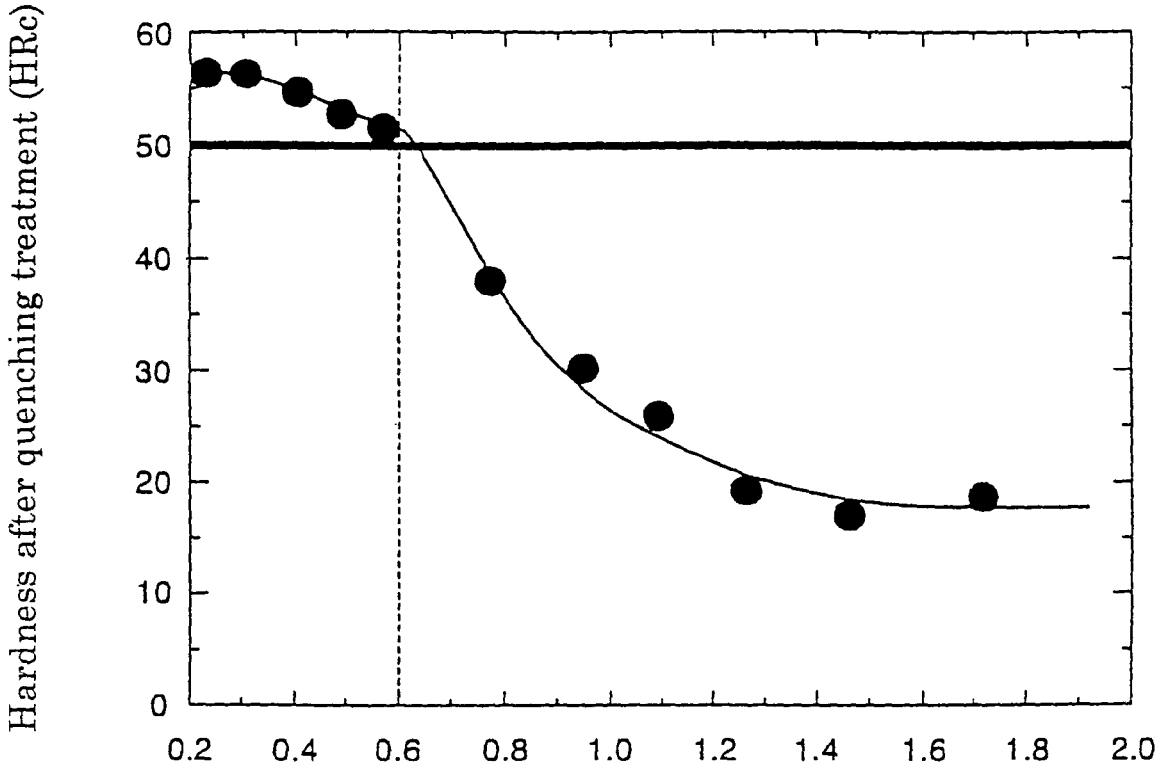
FIG. 1 shows the relationship between maximum diameter Dmax of carbide when 80% or more is the ratio of number of carbides having diameters ≦ Dmax with respect to all the carbides and hardness after quenching treatment.

FIG. 1 shows the relationship between maximum diameter Dmax of carbide when 80% or more is the ratio of number of carbides having diameters ≦ Dmax with respect to all the carbides and hardness after quenching treatment.

If the ratio of number of carbides having a diameter of 0.6 μm or less with respect to all the carbides is 80% or more, the HRc exceeds 50 and the good hardenability may be obtained. This is considered to be because fine carbides below 0.6 μm in diameter are rapidly dissolved into austenite phase when quenching.

Figure 2:
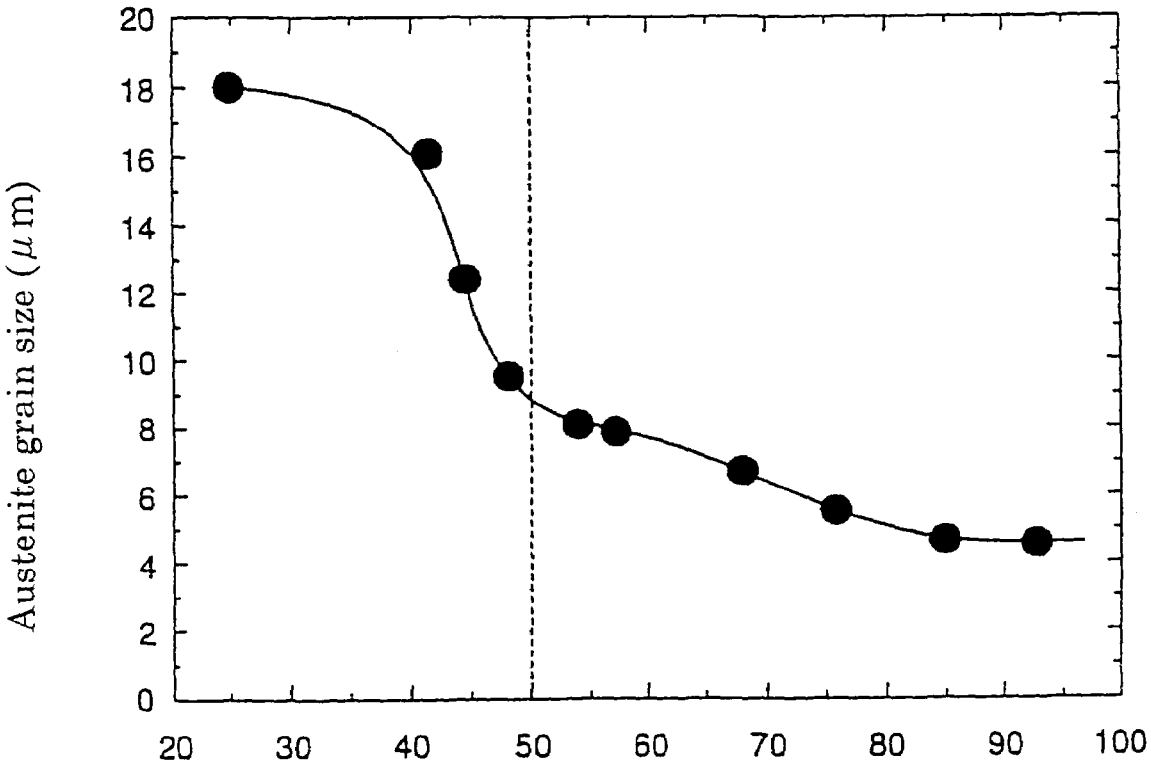
FIG. 2 shows the relationship between number of carbides having a diameter of 1.5 μm or larger which exist in 2500 $\mu m^2$ of observation field area of electron microscope and austenite grain size.

But, if the diameter of all the carbides are below 0.6 μm, all the carbides are dissolved into the austenite phase when quenching, so that the austenite grains are remarkably coarsened and the toughness might be deteriorated. For avoiding it, as shown in FIG. 2, more than 50 carbides having a diameter of 1.5 μm or larger should exist in 2500 $\mu m^2$ of observation field area of electron microscope.

(ii) Dimensional precision when forming

For improving the dimensional precision when forming, it is necessary that the Δr is made small as described above. But it is not known how small the Δr should be made to obtain an equivalent dimensional precision in gear parts conventionally produced by casting or forging. So, the relationship between Δr and dimensional precision when forming was studied. As a result, it was found that if the Δr was more than −0.15 to less than 0.15, the equivalent dimensional precision in gear parts produced by casting or forging could be provided.

If the Δmax of r-value instead of the Δr is made less than 0.2, the forming can be conducted with a higher dimensional precision.

The high carbon steel sheet under the existing condition of carbides as mentioned in (i) and having a Δr of more than −0.15 to less than 0.15 as mentioned in (ii), can be produced by a method comprising the steps of: hot rolling a steel having chemical composition specified by JIS G 4051, JIS G 4401 or JIS G 4802, coiling the hot rolled steel sheet at 520 to 600° C., descaling the coiled steel sheet, primarily annealing the descaled steel sheet at 640 to 690° C. for 20 hr or longer, cold rolling the annealed steel sheet at a reduction rate of 50% or more, and secondarily annealing the cold rolled steel sheet at 620 to 680° C. Detailed explanation will be made therefore as follows.

(1) Coiling Temperature

Since the coiling temperature lower than 520° C. makes pearlite structure very fine, carbides after the primary annealing are considerably fine, so that carbides having a diameter of 1.5 μm or larger cannot be produced after the secondary annealing. In contrast, exceeding 600° C., coarse pearlite structure is generated, so that carbides having a diameter of 0.6 μm or less cannot be produced after the secondary annealing. Accordingly, the coiling temperature is defined to be 520 to 600° C.

(2) Primary Annealing

If the primary annealing temperature is higher than 690° C., carbides are too much spheroidized, so that carbides having a diameter of 0.6 μm or less cannot be produced after the secondary annealing. On the other hand, being lower than 640° C., the spheroidization of carbides is difficult, so that carbides having a diameter of 1.5 μm or larger cannot be produced after the secondary annealing. Accordingly, the primary annealing temperature is defined to be 640 to 690° C. The annealing time should be 20 hr or longer for uniformly spheroidizing.

(3) Cold Reduction Rate

In general, the higher the cold reduction rate, the smaller the Δr, and for making Δr more than −0.15 to less than 0.15, the cold reduction rate of at least 50% is necessary.

(4) Secondary Annealing

If the secondary annealing temperature exceeds 680° C., carbides are greatly coarsened, the grain grows markedly, and the Δr increases. On the other hand, being lower than 620° C., carbides become fine, and recrystallization and grain growth are not sufficient, so that the workability decreases. Thus, the secondary annealing temperature is defined to be 620 to 680° C. For the secondary annealing, either a continuous annealing or a box annealing will do.

For producing the high carbon steel sheet under the existing condition of carbides as mentioned in (i) and having a Δmax of r-value of less than 0.2 as mentioned in (ii), the primary annealing temperature T1 and the secondary annealing temperature T2 in the above method should satisfy the following formula (1).

$$1024-0.6\times T1 \leqq T2 \leqq 1202-0.80\times T1 \ldots \quad (1)$$

Detailed explanation will be made therefore as follows.

By making a slab of, by wt %, C: 0.36%, Si: 0.20%, Mn: 0.75%, P: 0.011%, S: 0.002% and Al: 0.020%, hot rolling at a finishing temperature of 850° C. and coiling at a coiling temperature of 560° C., pickling, primarily annealing at 640 to 690° C. for 40 hr, cold rolling at a reduction rate of 60%, and secondarily annealing at 610 to 690° C. for 40 hr, steel sheets were produced, and the Δmax of r-value was measured.

Figure 3:
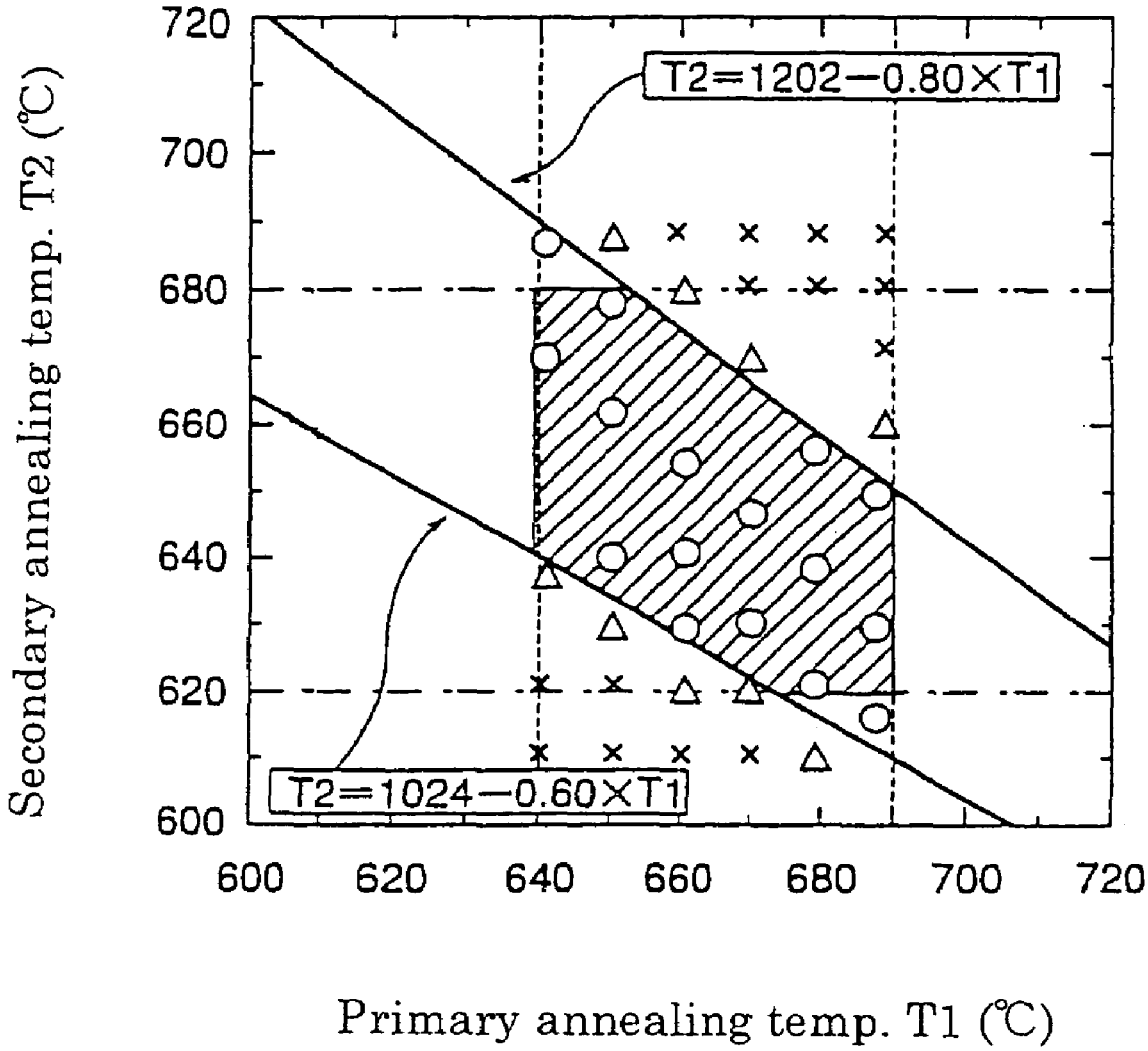
FIG. 3 shows the relationship between primary annealing temperature, secondary annealing temperature and Δmax of r-value.

As seen in FIG. 3, if the primary annealing temperature T1 is 640 to 690° C. and the secondary annealing temperature T2 is in response to the primary annealing temperature T1 to satisfy the above formula (1), the Δmax of r-value is less than 0.2.

At this time, if the secondary annealing temperature is higher than 680° C., carbides are coarsened, and carbides having a diameter of 0.6 μm or less cannot be obtained. In contrast, being lower than 620° C., carbides having a diameter of 1.5 μm or larger cannot be obtained. Therefore, the secondary annealing temperature is defined to be 620 to 680° C. For the secondary annealing, either a continuous annealing or a box annealing will do.

The Δmax of r-value can be made smaller, if the high carbon steel sheet is produced by such a method comprising the steps of: continuously casting into slab a steel having chemical composition specified by JIS G 4051, JIS G 4401 or JIS G 4802, rough rolling the slab to sheet bar without reheating the slab or after reheating the slab cooled to a certain temperature, finish rolling the sheet bar (rough rolled slab) after reheating the sheet bar to Ar3 transformation point or higher, coiling the finish rolled steel sheet at 500 to 650° C., descaling the coiled steel sheet, primarily annealing the descaled steel sheet at a temperature T1 of 630 to 700° C. for 20 hr or longer, cold rolling the annealed steel sheet at a reduction rate of 50% or higher, and secondarily annealing the cold rolled steel sheet at a temperature T2 of 620 to 680° C., wherein the temperature T1 and the temperature T2 satisfy the following formula (2).

$$1010-0.59\times T1 \leqq T2 \leqq 1210-0.80\times T1 \ldots \quad (2)$$

At this time, instead of finish rolling the sheet bar after reheating the sheet bar to Ar3 transformation point or higher, by finish rolling the sheet bar during reheating the rolled sheet bar to Ar3 transformation point or higher the similar effect is available. Detailed explanation will be made therefor as follows.

(5) Reheating the Sheet Bar

By finish rolling the sheet bar after reheating the sheet bar to Ar3 transformation point or higher or during reheating the rolled sheet bar to Ar3 transformation point or higher, crystal grains are uniformed in a thickness direction of steel sheet during rolling, the dispersion of carbides after the secondary annealing is small, and the planar anisotropy of r-value becomes smaller. Accordingly, more excellent hardenability and toughness, and higher dimensional precision when forming are obtained. The reheating time should be at least 3 seconds. As the reheating time is short like this, an induction heating is preferably applied.

(6) Coiling Temperature and Primary Annealing Temperature

If the sheet bar is reheated as above mentioned, the ranges of the coiling temperature and the primary annealing temperature are respectively enlarged to 500 to 650° C. and 630 to 700° C. as compared with the case where the sheet bar is not reheated.

(7) Relationship Between Primary Annealing Temperature T1 and Secondary Annealing Temperature T2

By making a slab of, by wt %, C: 0.36%, Si: 0.20%, Mn: 0.75%, P: 0.011%, S: 0.002% and Al: 0.020%, rough rolling, reheating the sheet bar at 1010° C. for 15 sec by an induction heater, finish rolling at 850° C., coiling at 560° C., pickling, primarily annealing at 640 to 700° C. for 40 hr, cold rolling at a reduction rate of 60%, and secondarily annealing at 610 to 690° C. for 40 hr, steel sheets were produced. Measurements were made on the (222) integrated reflective intensity in the thickness directions (surface, ¼ thickness and ½ thickness) by X-ray diffraction method.

As shown in Table 1, by reheating the sheet bar, the Δmax of (222) intensity being a difference between the maximum value and the minimum value of (222) integrated reflective intensity in the thickness direction becomes small, and therefore the structure is more uniformed in the thickness direction.

Figure 4:
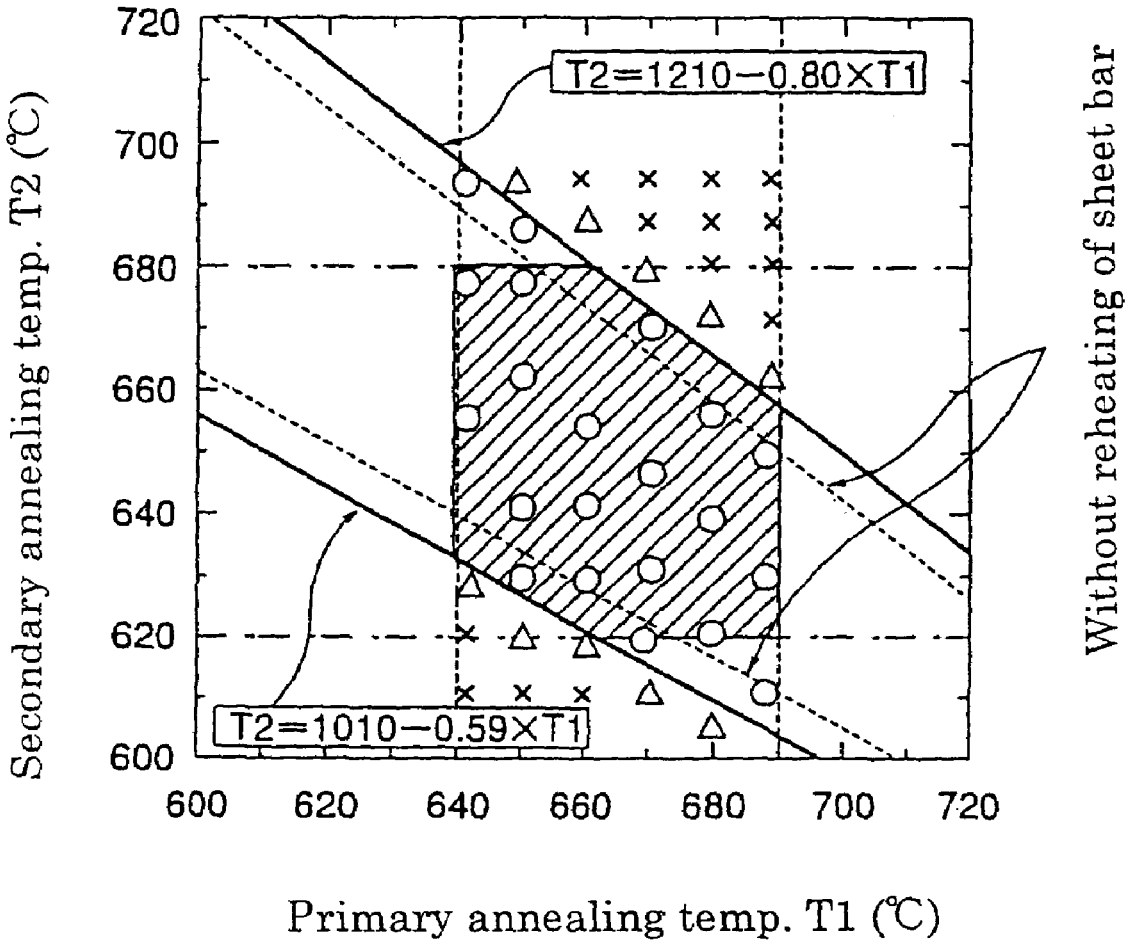
FIG. 4 shows the another relationship between primary annealing temperature, secondary annealing temperature and Δmax of r-value.

As seen in FIG. 4, within the range satisfying the above formula (2), the Δmax of r-value less than 0.15 is obtained. The range satisfying the above formula (2) is wider than that of the formula (1).

TABLE 1

| | | | Integrated reflective intensity (222) | | | |
|---|---|---|---|---|---|---|
| Reheating of sheet bar (° C. × sec) | Primary annealing (° C. × hr) | Secondary annealing (° C. × hr) | Surface | ¼ thickness | ½ thickness | Δmax |
| 1010 × 15 | 640 × 40 | 610 × 40 | 2.81 | 2.95 | 2.89 | 0.14 |
| 1010 × 15 | 640 × 40 | 650 × 40 | 2.82 | 2.88 | 2.95 | 0.13 |
| 1010 × 15 | 640 × 40 | 690 × 40 | 2.90 | 2.91 | 3.02 | 0.12 |
| 1010 × 15 | 680 × 40 | 610 × 40 | 2.37 | 2.35 | 2.46 | 0.11 |
| 1010 × 15 | 680 × 40 | 650 × 40 | 2.40 | 2.36 | 2.47 | 0.11 |
| 1010 × 15 | 680 × 40 | 690 × 40 | 2.29 | 2.34 | 2.39 | 0.10 |
| — | 640 × 40 | 610 × 40 | 2.70 | 3.01 | 2.90 | 0.31 |
| — | 640 × 40 | 650 × 40 | 2.75 | 2.87 | 2.99 | 0.24 |
| — | 640 × 40 | 690 × 40 | 2.81 | 2.90 | 3.05 | 0.24 |
| — | 680 × 40 | 610 × 40 | 2.34 | 2.27 | 2.50 | 0.23 |
| — | 680 × 40 | 650 × 40 | 2.39 | 2.23 | 2.51 | 0.28 |
| — | 680 × 40 | 690 × 40 | 2.25 | 2.37 | 2.45 | 0.20 |

For improving sliding property, the high carbon steel sheet of the present invention may be galvanized through an electro-galvanizing process or a hot dip Zn plating process, followed by a phosphating treatment.

To produce the high carbon steel sheet of the present invention, a continuous hot rolling process using a coil box may be applicable. In this case, the sheet bar may be reheated through rough rolling mills, before or after the coil box, or before and after a welding machine.

Example 1

By making a slab containing the chemical composition specified by S35C of JIS G 4051 (by wt %, C: 0.35%, Si: 0.20%, Mn: 0.76%, P: 0.016%, S: 0.003% and Al: 0.026%) through a continuous casting process, reheating to 1100° C., hot rolling, coiling, primarily annealing, cold rolling, secondarily annealing, under the conditions shown in Table 2, and temper rolling at a reduction rate of 1.5%, the steel sheets A–H of 1.0 mm thickness were produced. Herein, the steel sheet H is a conventional high carbon steel sheet. The existing condition of carbides and the hardenability were investigated by the above mentioned methods. Further, mechanical properties and austenite grain size were measured as follows.

(a) Mechanical Properties

JIS No. 5 test pieces were sampled from the directions of 0° (L), 45° (S) and 90° (C) with respect to the rolling direction, and subjected to the tensile test at a tension speed of 10 mm/min so as to measure the mechanical properties in each direction. The Δmax of each mechanical property, that is, a difference between the maximum value and the minimum value of each mechanical property, and the Δr were calculated.

(b) Austenite Grain Size

The cross section in a thickness direction of the quenched test piece for investigating the hardenability was polished, etched, and observed by an optical microscope. The austenite grain size number was measured following JIS G 0551.

The results are shown in Tables 2 and 3.

As to the inventive steel sheets A–C, the existing condition of carbides is within the range of the present invention, and therefore the HRc after quenching is above 50 and the good hardenability is obtained. The austenite grain size of these steel sheets is small, and therefore the excellent toughness is obtained. In addition, the Δr is more than −0.15 to less than 0.15, that is, the planar anisotropy is very small, and accordingly the forming is carried out with a high dimensional precision. At the same time, the Δmax of yield strength and tensile strength is 10 MPa or lower, the Δmax of the total elongation is 1.5% or lower, and thus each planar anisotropy is very small.

In contrast, the comparative steel sheets D–H have large Δmax of the mechanical properties and Δr. The steel sheet D has coarse austenite grain size. In the steel sheets E, G, and H, the HRc is less than 50.

TABLE 2

| Steel sheet | Coiling temperature (° C.) | Primary annealing (° C. × hr) | Cold reduction rate (%) | Secondary annealing (° C. × hr) | Number of carbides larger than 1.5 μm | Ratio of carbides smaller than 0.6 μm (%) | Remark Remark |
|---|---|---|---|---|---|---|---|
| A | 580 | 650 × 40 | 70 | 680 × 40 | 89 | 84 | Present invention |
| B | 560 | 640 × 20 | 60 | 660 × 40 | 84 | 87 | Present invention |
| C | 540 | 660 × 20 | 65 | 640 × 40 | 81 | 93 | Present invention |
| D | 500 | 640 × 40 | 60 | 660 × 40 | 64 | 96 | Comparative example |
| E | 560 | 710 × 40 | 65 | 660 × 40 | 103 | 58 | Comparative example |
| F | 540 | 660 × 20 | 40 | 680 × 40 | 86 | 84 | Comparative example |
| G | 550 | 640 × 20 | 60 | 720 × 40 | 98 | 61 | Comparative example |
| H | 620 | — | 50 | 690 × 40 | 74 | 70 | Comparative example |

TABLE 3

| Steel | Mechanical properties before quenching | | | | | | | | | | | | | | | | Hardness after quenching | Austenite Grain size | |
|---|---|---|---|---|---|---|---|---|---|---|---|---|---|---|---|---|---|---|---|
| | Yield strength (MPa) | | | | Tensile strength (MPa) | | | | Total elongation (%) | | | | r-value | | | | | | |
| sheet | L | S | C | Δmax | L | S | C | Δmax | L | S | C | Δmax | L | S | C | Δr | (HRc) | (size No.) | Remark |
| A | 395 | 391 | 393 | 4 | 506 | 502 | 507 | 5 | 35.7 | 36.4 | 35.9 | 0.7 | 1.06 | 0.97 | 1.04 | 0.04 | 52 | 11.6 | Present invention |
| B | 405 | 404 | 411 | 7 | 504 | 498 | 507 | 9 | 35.8 | 36.8 | 36.2 | 1.0 | 1.12 | 0.98 | 1.23 | 0.10 | 54 | 11.3 | Present invention |
| C | 409 | 406 | 414 | 8 | 509 | 505 | 513 | 8 | 35.2 | 36.4 | 35.3 | 1.2 | 0.98 | 1.19 | 1.05 | −0.09 | 56 | 10.7 | Present invention |
| D | 369 | 362 | 370 | 8 | 499 | 496 | 503 | 9 | 30.1 | 29.3 | 31.0 | 1.7 | 1.16 | 0.92 | 1.33 | 0.16 | 57 | 8.6 | Comparative example |

TABLE 3-continued

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δr | Hardness after quenching (HRc) | Austenite Grain size (size No.) | Remark |
|---|---|---|---|---|---|---|---|---|---|---|---|---|---|---|---|---|---|---|---|
| E | 370 | 379 | 375 | 9 | 480 | 484 | 481 | 4 | 36.9 | 36.0 | 36.4 | 0.9 | 1.15 | 0.96 | 1.47 | 0.18 | 44 | 12.2 | Comparative example |
| F | 374 | 377 | 385 | 11 | 474 | 480 | 488 | 14 | 35.7 | 34.6 | 36.3 | 1.7 | 1.25 | 0.96 | 1.46 | 0.20 | 53 | 11.2 | Comparative example |
| G | 372 | 376 | 379 | 7 | 496 | 493 | 498 | 5 | 38.0 | 37.7 | 37.7 | 0.3 | 1.14 | 0.94 | 1.64 | 0.23 | 40 | 12.1 | Comparative example |
| H | 317 | 334 | 320 | 17 | 501 | 516 | 510 | 15 | 36.5 | 34.6 | 35.5 | 1.9 | 1.12 | 0.92 | 1.35 | 0.16 | 49 | 11.6 | Comparative example |

Example 2

By making a slab containing the chemical composition specified by S35C of JIS G 4051 (by wt %, C: 0.36%, Si: 0.20%, Mn: 0.75%, P: 0.011%, S: 0.002% and Al: 0.020%) through a continuous casting process, reheating to 1100° C., hot rolling, coiling, primarily annealing, cold rolling, secondarily annealing, under the conditions shown in Table 4, and temper rolling at a reduction rate of 1.5%, the steel sheets 1–19 of 2.5 mm thickness were produced. Herein, the steel sheet 19 is a conventional high carbon steel sheet. The same measurements as in Example 1 were conducted. The Δmax of r-value was calculated in stead of Δr.

The results are shown in Tables 4 and 5.

As to the inventive steel sheets 1–7, the existing condition of carbides is within the range of the present invention, and therefore the HRc after quenching is above 50 and the good hardenability is obtained. The austenite grain size of these steel sheets is small, and therefore the excellent toughness is obtained. In addition, the Δmax of r-value is below 0.2, that is, the planar anisotropy is extremely small, and accordingly the forming is carried out with a high dimensional precision. At the same time, the Δmax of yield strength and tensile strength is 10 MPa or lower, the Δmax of the total elongation is 1.5% or lower, and thus each planar anisotropy is very small.

In contrast, the comparative steel sheets 8–19 have large Δmax of the mechanical properties. The steel sheets 8, 10, 17 and 18 have coarse austenite grain size. In the steel sheets 9, 11, 15, 16 and 19, the HRc is less than 50.

TABLE 4

| Steel sheet | Coiling temperature (° C.) | Primary annealing (° C. × hr) | Cold reduction rate (%) | Secondary annealing (° C. × hr) | Secondary annealing range by the formula (1) | Number of carbides larger than 1.5 μm | Ratio of carbides smaller than 0.6 μm (%) | Remark |
|---|---|---|---|---|---|---|---|---|
| 1 | 580 | 640 × 40 | 70 | 680 × 40 | 640–680 | 56 | 85 | Present invention |
| 2 | 530 | 640 × 20 | 60 | 680 × 40 | 640–680 | 52 | 87 | Present invention |
| 3 | 595 | 640 × 40 | 60 | 680 × 20 | 640–680 | 64 | 81 | Present invention |
| 4 | 580 | 660 × 40 | 60 | 660 × 40 | 628–674 | 61 | 83 | Present invention |
| 5 | 580 | 680 × 20 | 60 | 640 × 40 | 620–658 | 63 | 82 | Present invention |
| 6 | 580 | 640 × 40 | 50 | 660 × 40 | 640–680 | 56 | 85 | Present invention |
| 7 | 580 | 640 × 40 | 70 | 640 × 40 | 640–680 | 54 | 86 | Present invention |
| 8 | 510 | 640 × 20 | 60 | 680 × 40 | 640–680 | 30 | 92 | Comparative example |
| 9 | 610 | 640 × 20 | 60 | 680 × 20 | 640–680 | 68 | 61 | Comparative example |
| 10 | 580 | 620 × 40 | 60 | 680 × 40 | — | 32 | 90 | Comparative example |
| 11 | 580 | 720 × 40 | 60 | 680 × 40 | — | 68 | 65 | Comparative example |
| 12 | 580 | 640 × 15 | 70 | 680 × 40 | 640–680 | 54 | 86 | Comparative example |
| 13 | 580 | 640 × 40 | 30 | 680 × 40 | 640–680 | 58 | 84 | Comparative example |

TABLE 4-continued

| Steel sheet | Coiling temperature (° C.) | Primary annealing (° C. × hr) | Cold reduction rate (%) | Secondary annealing (° C. × hr) | Secondary annealing range by the formula (1) | Number of carbides larger than 1.5 μm | Ratio of carbides smaller than 0.6 μm (%) | Remark |
|---|---|---|---|---|---|---|---|---|
| 14 | 580 | 660 × 20 | 60 | 620 × 40 | 628–674 | 60 | 84 | Comparative example |
| 15 | 580 | 640 × 20 | 60 | 700 × 40 | 640–680 | 66 | 73 | Comparative example |
| 16 | 580 | 640 × 40 | 60 | 690 × 40 | 640–680 | 67 | 70 | Comparative example |
| 17 | 580 | 690 × 40 | 60 | 615 × 40 | 620–650 | 33 | 88 | Comparative example |
| 18 | 500 | 640 × 20 | 60 | 640 × 20 | 640–690 | 45 | 88 | Comparative example |
| 19 | 620 | — | 50 | 690 × 40 | — | 51 | 67 | Comparative example |

TABLE 5

| Steel | Mechanical properties before quenching | | | | | | | | | | | | | | | | Hardness after quenching | Austenite Grain size | |
|---|---|---|---|---|---|---|---|---|---|---|---|---|---|---|---|---|---|---|---|
| | Yield strength (MPa) | | | | Tensile strength (MPa) | | | | Total elongation (%) | | | | r-value | | | | | | |
| sheet | L | S | C | Δmax | L | S | C | Δmax | L | S | C | Δmax | L | S | C | Δmax | (HRc) | (size No.) | Remark |
| 1 | 398 | 394 | 402 | 8 | 506 | 508 | 513 | 5 | 36.2 | 37.4 | 37.0 | 1.2 | 1.07 | 0.99 | 1.00 | 0.08 | 54 | 11.1 | Present invention |
| 2 | 410 | 407 | 412 | 5 | 513 | 512 | 516 | 4 | 36.8 | 38.0 | 36.8 | 1.2 | 1.02 | 1.01 | 1.11 | 0.10 | 56 | 10.9 | Present invention |
| 3 | 350 | 348 | 351 | 3 | 470 | 474 | 472 | 2 | 36.3 | 36.8 | 36.2 | 0.6 | 1.01 | 1.01 | 1.09 | 0.08 | 51 | 11.6 | Present invention |
| 4 | 395 | 398 | 404 | 9 | 507 | 506 | 509 | 3 | 36.6 | 37.5 | 37.3 | 0.9 | 1.09 | 0.99 | 1.01 | 0.10 | 52 | 11.5 | Present invention |
| 5 | 392 | 397 | 400 | 8 | 502 | 503 | 501 | 2 | 37.9 | 38.2 | 38.0 | 0.3 | 0.95 | 1.13 | 1.00 | 0.18 | 51 | 11.5 | Present invention |
| 6 | 401 | 398 | 407 | 9 | 509 | 509 | 512 | 3 | 37.5 | 37.9 | 38.5 | 1.0 | 0.94 | 1.07 | 1.02 | 0.13 | 53 | 11.3 | Present invention |
| 7 | 404 | 401 | 410 | 9 | 510 | 509 | 512 | 3 | 35.3 | 36.7 | 36.6 | 1.4 | 1.03 | 1.18 | 1.01 | 0.17 | 55 | 11.0 | Present invention |
| 8 | 374 | 367 | 374 | 7 | 507 | 505 | 508 | 3 | 29.9 | 28.4 | 31.3 | 2.9 | 1.17 | 1.01 | 1.43 | 0.42 | 58 | 8.3 | Comparative example |
| 9 | 371 | 386 | 380 | 15 | 482 | 491 | 485 | 9 | 27.1 | 25.0 | 26.7 | 2.1 | 1.14 | 0.93 | 1.31 | 0.38 | 40 | 12.0 | Comparative example |
| 10 | 395 | 396 | 399 | 4 | 512 | 512 | 515 | 3 | 27.0 | 25.4 | 28.2 | 2.8 | 1.27 | 0.98 | 1.28 | 0.30 | 58 | 8.9 | Comparative example |
| 11 | 372 | 384 | 380 | 12 | 484 | 489 | 485 | 5 | 37.7 | 36.9 | 37.3 | 0.8 | 1.24 | 1.00 | 1.34 | 0.34 | 42 | 12.0 | Comparative example |
| 12 | 390 | 384 | 377 | 13 | 490 | 500 | 498 | 10 | 29.0 | 24.9 | 29.4 | 4.5 | 1.19 | 0.94 | 1.29 | 0.35 | 56 | 10.9 | Comparative example |
| 13 | 372 | 383 | 390 | 18 | 480 | 486 | 493 | 13 | 35.5 | 33.7 | 36.5 | 2.8 | 1.02 | 0.96 | 1.48 | 0.52 | 53 | 11.3 | Comparative example |
| 14 | 404 | 401 | 410 | 9 | 510 | 508 | 513 | 5 | 35.1 | 37.0 | 36.7 | 1.9 | 1.01 | 1.28 | 0.94 | 0.34 | 52 | 11.4 | Comparative example |
| 15 | 385 | 386 | 376 | 10 | 503 | 501 | 506 | 5 | 37.5 | 36.8 | 36.4 | 1.1 | 1.28 | 1.00 | 1.31 | 0.31 | 45 | 11.8 | Comparative example |
| 16 | 388 | 389 | 378 | 11 | 504 | 501 | 507 | 6 | 37.3 | 36.5 | 36.0 | 1.3 | 1.18 | 0.98 | 1.36 | 0.38 | 43 | 11.9 | Comparative example |

TABLE 5-continued

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite Grain size (size No.) | Remark |
|---|---|---|---|---|---|---|---|---|---|---|---|---|---|---|---|---|---|---|---|
| 17 | 410 | 406 | 417 | 11 | 513 | 510 | 515 | 5 | 35.3 | 36.7 | 36.5 | 1.4 | 1.02 | 1.26 | 0.92 | 0.34 | 56 | 9.9 | Comparative example |
| 18 | 412 | 406 | 415 | 9 | 514 | 511 | 519 | 8 | 35.1 | 36.5 | 36.3 | 1.4 | 0.97 | 1.22 | 0.88 | 0.34 | 57 | 9.4 | Comparative example |
| 19 | 322 | 335 | 322 | 13 | 510 | 519 | 514 | 9 | 36.1 | 34.1 | 35.9 | 2.0 | 1.12 | 0.93 | 1.36 | 0.43 | 43 | 12.0 | Comparative example |

Example 3

By making a slab containing the chemical composition specified by S65C-CSP of JIS G 4802 (by wt %, C: 0.65%, Si: 0.19%, Mn: 0.73%, P: 0.011%, S: 0.002% and Al: 0.020%) through a continuous casting process, reheating to 1100° C., hot rolling, coiling, primarily annealing, cold rolling, secondarily annealing, under the conditions shown in Table 6, and temper rolling at a reduction rate of 1.5%, the steel sheets 20–38 of 2.5 mm thickness were produced. Herein, the steel sheet 38 is a conventional high carbon steel sheet. The same measurements as in Example 2 were conducted.

The results are shown in Tables 6 and 7.

As to the inventive steel sheets 20–26, the existing condition of carbides is within the range of the present invention, and therefore the HRc after quenching is above 50 and the good hardenability is obtained. The austenite grain size of these steel sheets is small, and therefore the excellent toughness is obtained. In addition, the Δmax of r-value is below 0.2, that is, the planar anisotropy is extremely small, and accordingly the forming is carried out with a high dimensional precision. At the same time, the Δmax of yield strength and tensile strength is 15 MPa or lower, the Δmax of the total elongation is 1.5% or lower, and thus each planar anisotropy is very small.

In contrast, the comparative steel sheets 27–38 have large Δmax of the mechanical properties. The steel sheets 27, 29 and 36 have coarse austenite grain size. In the steel sheets 28 and 38, the HRc is less than 50.

TABLE 6

| Steel sheet | Coiling temperature (° C.) | Primary annealing (° C. × hr) | Cold reduction rate (%) | Secondary annealing (° C. × hr) | Secondary annealing range by the formula (1) | Number of carbides larger than 1.5 μm | Ratio of carbides smaller than 0.6 μm (%) | Remark |
|---|---|---|---|---|---|---|---|---|
| 20 | 560 | 640 × 40 | 70 | 680 × 40 | 640–680 | 86 | 86 | Present invention |
| 21 | 530 | 640 × 20 | 60 | 680 × 40 | 640–680 | 82 | 88 | Present invention |
| 22 | 595 | 640 × 40 | 60 | 680 × 20 | 640–680 | 94 | 82 | Present invention |
| 23 | 560 | 660 × 40 | 60 | 660 × 40 | 628–674 | 90 | 83 | Present invention |
| 24 | 560 | 680 × 20 | 60 | 640 × 40 | 620–658 | 92 | 83 | Present invention |
| 25 | 560 | 640 × 40 | 50 | 660 × 40 | 640–680 | 87 | 85 | Present invention |
| 26 | 560 | 640 × 40 | 70 | 640 × 40 | 640–680 | 83 | 86 | Present invention |
| 27 | 510 | 640 × 20 | 60 | 680 × 40 | 640–680 | 44 | 93 | Comparative example |
| 28 | 610 | 640 × 20 | 60 | 680 × 20 | 640–680 | 101 | 62 | Comparative example |
| 29 | 560 | 620 × 40 | 60 | 680 × 40 | — | 47 | 91 | Comparative example |
| 30 | 560 | 720 × 40 | 60 | 680 × 40 | — | 100 | 64 | Comparative example |
| 31 | 560 | 640 × 15 | 70 | 680 × 40 | 640–680 | 83 | 87 | Comparative example |
| 32 | 560 | 640 × 40 | 30 | 680 × 40 | 640–680 | 88 | 85 | Comparative example |
| 33 | 560 | 660 × 20 | 60 | 620 × 40 | 630–674 | 89 | 84 | Comparative example |
| 34 | 560 | 640 × 20 | 60 | 700 × 40 | 640–680 | 98 | 72 | Comparative example |

TABLE 6-continued

| Steel sheet | Coiling temperature (° C.) | Primary annealing (° C. × hr) | Cold reduction rate (%) | Secondary annealing (° C. × hr) | Secondary annealing range by the formula (1) | Number of carbides larger than 1.5 μm | Ratio of carbides smaller than 0.6 μm (%) | Remark |
|---|---|---|---|---|---|---|---|---|
| 35 | 560 | 640 × 40 | 60 | 690 × 40 | 640–680 | 99 | 70 | Comparative example |
| 36 | 560 | 690 × 40 | 60 | 615 × 40 | 620–650 | 49 | 89 | Comparative example |
| 37 | 610 | 690 × 40 | 50 | 650 × 40 | 610–650 | 96 | 77 | Comparative example |
| 38 | 620 | — | 50 | 690 × 40 | — | 100 | 65 | Comparative example |

TABLE 7

| Steel | Mechanical properties before quenching | | | | | | | | | | | | | | | | Hardness after quenching | Austetine Grain size | |
|---|---|---|---|---|---|---|---|---|---|---|---|---|---|---|---|---|---|---|---|
| | Yield strength (MPa) | | | | Tensile strength (MPa) | | | | Total elongation (%) | | | | r-value | | | | | (size | |
| sheet | L | S | C | Δmax | L | S | C | Δmax | L | S | C | Δmax | L | S | C | Δmax | (HRc) | No.) | Remark |
| 20 | 412 | 406 | 413 | 7 | 515 | 518 | 523 | 8 | 34.2 | 35.7 | 35.2 | 1.5 | 1.04 | 0.96 | 0.97 | 0.08 | 63 | 11.2 | Present invention |
| 21 | 422 | 419 | 427 | 8 | 524 | 521 | 526 | 5 | 35.1 | 36.0 | 34.6 | 1.4 | 0.98 | 1.00 | 1.06 | 0.08 | 64 | 11.0 | Present invention |
| 22 | 365 | 360 | 363 | 5 | 480 | 483 | 480 | 3 | 34.5 | 35.0 | 34.1 | 0.9 | 0.97 | 0.98 | 1.07 | 0.10 | 60 | 11.7 | Present invention |
| 23 | 409 | 409 | 416 | 7 | 518 | 514 | 519 | 5 | 34.7 | 35.7 | 34.2 | 1.5 | 1.02 | 0.97 | 0.93 | 0.09 | 61 | 11.6 | Present invention |
| 24 | 405 | 410 | 415 | 10 | 511 | 512 | 512 | 1 | 35.8 | 36.1 | 36.2 | 0.4 | 0.89 | 1.11 | 0.94 | 0.19 | 60 | 11.6 | Present invention |
| 25 | 416 | 412 | 423 | 11 | 519 | 517 | 523 | 6 | 35.4 | 36.0 | 36.7 | 1.3 | 0.92 | 1.03 | 0.95 | 0.14 | 62 | 11.4 | Present invention |
| 26 | 417 | 414 | 424 | 10 | 521 | 515 | 524 | 9 | 33.4 | 34.9 | 34.7 | 1.5 | 1.00 | 1.15 | 0.98 | 0.17 | 63 | 11.1 | Present invention |
| 27 | 385 | 380 | 388 | 8 | 518 | 515 | 518 | 3 | 28.2 | 24.8 | 28.2 | 3.4 | 1.22 | 0.96 | 1.28 | 0.32 | 66 | 8.4 | Comparative example |
| 28 | 385 | 400 | 395 | 15 | 489 | 500 | 493 | 11 | 25.7 | 23.2 | 25.2 | 2.5 | 1.15 | 0.89 | 1.22 | 0.33 | 48 | 12.2 | Comparative example |
| 29 | 406 | 410 | 413 | 7 | 519 | 523 | 526 | 7 | 25.5 | 24.0 | 26.7 | 2.7 | 1.21 | 0.97 | 1.36 | 0.39 | 66 | 9.0 | Comparative example |
| 30 | 384 | 397 | 394 | 13 | 492 | 500 | 496 | 8 | 35.8 | 34.6 | 35.6 | 1.2 | 1.20 | 0.90 | 1.18 | 0.30 | 50 | 12.1 | Comparative example |
| 31 | 405 | 398 | 389 | 16 | 500 | 510 | 511 | 11 | 27.1 | 22.4 | 27.4 | 5.0 | 0.94 | 1.25 | 0.97 | 0.31 | 64 | 11.1 | Comparative example |
| 32 | 386 | 396 | 406 | 20 | 486 | 497 | 503 | 17 | 33.7 | 31.9 | 34.8 | 2.9 | 0.81 | 1.17 | 0.94 | 0.36 | 62 | 11.4 | Comparative example |
| 33 | 416 | 412 | 425 | 13 | 521 | 516 | 523 | 7 | 33.2 | 35.1 | 34.8 | 1.9 | 1.04 | 1.32 | 1.01 | 0.31 | 61 | 11.5 | Comparative example |
| 34 | 402 | 391 | 388 | 14 | 512 | 510 | 515 | 5 | 35.7 | 34.8 | 34.3 | 1.4 | 1.22 | 0.97 | 1.34 | 0.37 | 53 | 11.9 | Comparative example |
| 35 | 405 | 395 | 394 | 11 | 514 | 511 | 517 | 6 | 35.5 | 34.8 | 34.1 | 1.4 | 1.17 | 0.88 | 1.18 | 0.30 | 51 | 12.0 | Comparative example |
| 36 | 420 | 417 | 431 | 14 | 523 | 519 | 525 | 6 | 33.3 | 34.8 | 34.5 | 1.5 | 1.00 | 1.26 | 0.93 | 0.33 | 65 | 10.0 | Comparative example |

TABLE 7-continued

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite Grain size (size No.) | Remark |
|---|---|---|---|---|---|---|---|---|---|---|---|---|---|---|---|---|---|---|---|
| 37 | 375 | 363 | 370 | 12 | 482 | 490 | 485 | 8 | 34.3 | 35.2 | 34.0 | 1.2 | 1.21 | 0.93 | 1.24 | 0.31 | 56 | 11.8 | Comparative example |
| 38 | 336 | 350 | 331 | 19 | 517 | 528 | 526 | 11 | 34.5 | 32.4 | 33.8 | 2.1 | 1.10 | 0.83 | 1.29 | 0.44 | 46 | 12.4 | Comparative example |

Example 4

By making a slab containing the chemical composition specified by S35C of JIS G 4051 (by wt %, C: 0.36%, Si: 0.20%, Mn: 0.75%, P: 0.011%, S: 0.002% and Al: 0.020%) through a continuous casting process, reheating to 1100° C., hot rolling, coiling, primarily annealing, cold rolling, secondarily annealing, under the conditions shown in Tables 8 and 9, and temper rolling at a reduction rate of 1.5%, the steel sheets 39–64 of 2.5 mm thickness were produced. In this example, the reheating of sheet bar was conducted for some steel sheets. Herein, the steel sheet 64 is a conventional high carbon steel sheet. The same measurements as in Example 2 were conducted. The Δmax of (222) intensity as above mentioned was also measured.

The results are shown in Tables 8–12.

As to the inventive steel sheets 39–52, the existing condition of carbides is within the range of the present invention, and therefore the HRc after quenching is above 50 and the good hardenability is obtained. The austenite grain size of these steel sheets is small, and therefore the excellent toughness is obtained. In addition, the Δmax of r-value is below 0.2, that is, the planar anisotropy is extremely small, and accordingly the forming is carried out with a high dimensional precision. At the same time, the Δmax of yield strength and tensile strength is 10 MPa or lower, the Δmax of the total elongation is 1.5% or lower, and thus each planar anisotropy is very small. In particular, the steel sheets 39–45 of which the sheet bar was reheated have small Δmax of (222) intensity in the thickness direction, and therefore more uniformed structure in the thickness direction.

In contrast, the comparative steel sheets 53–64 have large Δmax of the mechanical properties. The steel sheets 53, 55, 62 and 63 have coarse austenite grain size. In the steel sheets 54, 56, 60, 61 and 64, the HRc is less than 50.

TABLE 8

| Steel sheet | Reheating of sheet bar (° C. × sec) | Coiling temperature (° C.) | Primary annealing (° C. × hr) | Cold reduction rate (%) | Secondary annealing (° C. × hr) | Secondary annealing range by the formula (1) | Number of carbides larger than 1.5 μm | Ratio of carbides smaller than 0.6 μm (%) | Remark |
|---|---|---|---|---|---|---|---|---|---|
| 39 | 1050 × 15 | 580 | 640 × 40 | 70 | 680 × 40 | 632–680 | 55 | 86 | Present invention |
| 40 | 1100 × 3 | 530 | 640 × 20 | 60 | 680 × 40 | 632–680 | 52 | 87 | Present invention |
| 41 | 950 × 3 | 595 | 640 × 40 | 60 | 680 × 20 | 632–680 | 64 | 81 | Present invention |
| 42 | 1050 × 15 | 580 | 660 × 40 | 60 | 660 × 40 | 620–680 | 60 | 84 | Present invention |
| 43 | 1050 × 15 | 580 | 680 × 20 | 60 | 640 × 40 | 620–666 | 62 | 82 | Present invention |
| 44 | 1050 × 15 | 580 | 640 × 40 | 50 | 660 × 40 | 632–680 | 56 | 85 | Present invention |
| 45 | 1050 × 15 | 580 | 640 × 40 | 70 | 640 × 40 | 632–680 | 54 | 86 | Present invention |
| 46 | — | 580 | 640 × 40 | 70 | 680 × 40 | 632–680 | 56 | 85 | Present invention |
| 47 | — | 530 | 640 × 20 | 60 | 680 × 40 | 632–680 | 53 | 86 | Present invention |
| 48 | — | 595 | 640 × 40 | 60 | 680 × 20 | 632–680 | 64 | 81 | Present invention |
| 49 | — | 580 | 660 × 40 | 60 | 660 × 40 | 620–680 | 61 | 83 | Present invention |
| 50 | — | 580 | 680 × 20 | 60 | 640 × 40 | 620–666 | 63 | 82 | Present invention |
| 51 | — | 580 | 640 × 40 | 50 | 660 × 40 | 632–680 | 56 | 85 | Present invention |
| 52 | — | 580 | 640 × 40 | 70 | 640 × 40 | 632–680 | 55 | 85 | Present invention |

TABLE 8-continued

| Steel sheet | Reheating of sheet bar (° C. × sec) | Coiling tempe-rature (° C.) | Primary annealing (° C. × hr) | Cold reduc-tion rate (%) | Secondary annealing (° C. × hr) | Secondary annealing range by the formula (1) | Number of carbides larger than 1.5 μm | Ratio of carbides smaller than 0.6 μm (%) | Remark |
|---|---|---|---|---|---|---|---|---|---|
| 53 | 1050 × 15 | 510 | 640 × 20 | 60 | 680 × 40 | 632–680 | 30 | 92 | Comparative example |
| 54 | 1100 × 3 | 610 | 640 × 20 | 60 | 680 × 20 | 632–680 | 67 | 61 | Comparative example |
| 55 | 950 × 3 | 580 | 620 × 40 | 60 | 680 × 40 | — | 32 | 89 | Comparative example |
| 56 | 1050 × 15 | 580 | 720 × 40 | 60 | 680 × 40 | — | 68 | 65 | Comparative example |
| 57 | 1050 × 15 | 580 | 640 × 15 | 70 | 680 × 40 | 632–680 | 55 | 86 | Comparative example |
| 58 | 1050 × 15 | 580 | 640 × 40 | 30 | 680 × 40 | 632–680 | 58 | 84 | Comparative example |
| 59 | 1050 × 15 | 580 | 660 × 20 | 60 | 610 × 40 | 620–680 | 60 | 84 | Comparative example |
| 60 | 1050 × 15 | 580 | 640 × 20 | 60 | 700 × 40 | 632–680 | 66 | 74 | Comparative example |
| 61 | 1050 × 15 | 580 | 640 × 40 | 60 | 690 × 40 | 632–680 | 66 | 70 | Comparative example |
| 62 | 1050 × 15 | 580 | 690 × 40 | 60 | 615 × 40 | 620–658 | 33 | 88 | Comparative example |
| 63 | 1050 × 15 | 520 | 640 × 20 | 60 | 640 × 20 | 632–680 | 45 | 88 | Comparative example |
| 64 | 1050 × 15 | 620 | — | 50 | 690 × 40 | — | 33 | 87 | Comparative example |

TABLE 9

| Steel sheet | Reheating of sheet bar (° C. × sec) | Coiling temperature (° C.) | Primary annealing (° C. × hr) | Cold reduction rate (%) | Secondary annealing (° C. × hr) | Secondary annealing range by the formula (l) | Number of carbides larger than 1.5 μm | Ratio of carbides smaller than 0.6 μm (%) | Remark |
|---|---|---|---|---|---|---|---|---|---|
| 52 | — | 580 | 640 × 40 | 70 | 640 × 40 | 632–680 | 55 | 85 | Present invention |
| 53 | 1050 × 15 | 510 | 640 × 20 | 60 | 680 × 40 | 632–680 | 30 | 92 | Comparative example |
| 54 | 1100 × 3 | 610 | 640 × 20 | 60 | 680 × 20 | 632–680 | 67 | 61 | Comparative example |
| 55 | 950 × 3 | 580 | 620 × 40 | 60 | 680 × 40 | — | 32 | 89 | Comparative example |
| 56 | 1050 × 15 | 580 | 720 × 40 | 60 | 680 × 40 | — | 68 | 65 | Comparative example |
| 57 | 1050 × 15 | 580 | 640 × 15 | 70 | 680 × 40 | 632–680 | 55 | 86 | Comparative example |
| 58 | 1050 × 15 | 580 | 640 × 40 | 30 | 680 × 40 | 632–680 | 58 | 84 | Comparative example |
| 59 | 1050 × 15 | 580 | 660 × 20 | 60 | 610 × 40 | 620–680 | 60 | 84 | Comparative example |
| 60 | 1050 × 15 | 580 | 640 × 20 | 60 | 700 × 40 | 632–680 | 66 | 74 | Comparative example |
| 61 | 1050 × 15 | 580 | 640 × 40 | 60 | 690 × 40 | 632–680 | 66 | 70 | Comparative example |
| 62 | 1050 × 15 | 580 | 690 × 40 | 60 | 615 × 40 | 620–658 | 33 | 88 | Comparative example |
| 63 | 1050 × 15 | 520 | 640 × 20 | 60 | 640 × 20 | 632–680 | 45 | 88 | Comparative example |
| 64 | 1050 × 15 | 620 | — | 50 | 690 × 40 | — | 33 | 87 | Comparative example |

TABLE 10

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite grain size (size No.) | Remark |
|---|---|---|---|---|---|---|---|---|---|---|---|---|---|---|---|---|---|---|---|
| 39 | 398 | 394 | 398 | 4 | 506 | 508 | 512 | 6 | 36.5 | 37.4 | 37.0 | 0.9 | 1.07 | 0.99 | 1.02 | 0.08 | 55 | 11.0 | Present invention |
| 40 | 410 | 407 | 410 | 3 | 514 | 512 | 516 | 4 | 36.8 | 37.7 | 36.8 | 0.9 | 1.04 | 1.01 | 1.11 | 0.10 | 56 | 10.9 | Present invention |
| 41 | 351 | 348 | 350 | 3 | 470 | 474 | 473 | 4 | 36.4 | 36.8 | 36.2 | 0.6 | 1.03 | 1.01 | 1.09 | 0.08 | 51 | 11.6 | Present invention |
| 42 | 395 | 398 | 400 | 5 | 508 | 506 | 509 | 3 | 36.8 | 37.5 | 37.3 | 0.7 | 1.09 | 0.99 | 1.02 | 0.10 | 53 | 11.4 | Present invention |
| 43 | 395 | 397 | 400 | 5 | 501 | 503 | 501 | 2 | 37.9 | 38.2 | 38.1 | 0.3 | 0.95 | 1.09 | 1.00 | 0.14 | 52 | 11.4 | Present invention |
| 44 | 401 | 399 | 404 | 5 | 509 | 510 | 512 | 3 | 37.7 | 37.9 | 38.5 | 0.8 | 0.94 | 1.07 | 1.04 | 0.13 | 53 | 11.3 | Present invention |
| 45 | 404 | 401 | 405 | 4 | 511 | 509 | 512 | 3 | 35.7 | 36.7 | 36.6 | 1.0 | 1.03 | 1.15 | 1.01 | 0.14 | 55 | 11.0 | Present invention |
| 46 | 397 | 394 | 402 | 8 | 506 | 508 | 513 | 7 | 36.2 | 37.4 | 37.1 | 1.2 | 1.14 | 0.99 | 1.00 | 0.15 | 54 | 11.1 | Present invention |
| 47 | 409 | 407 | 412 | 5 | 514 | 512 | 516 | 4 | 36.8 | 38.0 | 36.9 | 1.2 | 1.02 | 1.01 | 1.14 | 0.16 | 55 | 11.0 | Present invention |
| 48 | 351 | 348 | 351 | 3 | 470 | 474 | 469 | 5 | 36.4 | 36.8 | 36.2 | 0.6 | 1.01 | 0.98 | 1.13 | 0.15 | 51 | 11.8 | Present invention |
| 49 | 395 | 397 | 404 | 9 | 507 | 505 | 509 | 4 | 36.6 | 37.5 | 37.2 | 0.9 | 1.13 | 0.96 | 1.01 | 0.17 | 52 | 11.5 | Present invention |
| 50 | 392 | 396 | 400 | 8 | 502 | 505 | 501 | 4 | 37.2 | 38.2 | 38.0 | 1.0 | 0.95 | 1.14 | 1.00 | 0.19 | 51 | 11.5 | Present invention |
| 51 | 403 | 398 | 407 | 9 | 509 | 505 | 512 | 3 | 37.5 | 37.7 | 38.5 | 1.0 | 0.94 | 1.12 | 1.02 | 0.18 | 53 | 11.3 | Present invention |

TABLE 11

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite grain size (size No.) | Remark |
|---|---|---|---|---|---|---|---|---|---|---|---|---|---|---|---|---|---|---|---|
| 52 | 405 | 401 | 410 | 9 | 510 | 507 | 512 | 5 | 35.3 | 36.7 | 36.4 | 1.4 | 1.03 | 1.19 | 1.00 | 0.19 | 54 | 11.1 | Present invention |
| 53 | 372 | 364 | 374 | 10 | 507 | 503 | 508 | 5 | 29.8 | 28.4 | 31.3 | 2.9 | 1.26 | 1.02 | 1.37 | 0.35 | 58 | 8.3 | Comparative example |
| 54 | 371 | 386 | 379 | 15 | 482 | 491 | 484 | 9 | 27.1 | 25.0 | 26.3 | 2.1 | 1.27 | 0.98 | 1.27 | 0.29 | 41 | 12.0 | Comparative example |
| 55 | 392 | 396 | 399 | 7 | 512 | 509 | 515 | 6 | 27.2 | 25.4 | 28.2 | 2.8 | 1.33 | 1.04 | 1.38 | 0.32 | 58 | 9.0 | Comparative example |
| 56 | 372 | 385 | 380 | 13 | 484 | 489 | 486 | 5 | 37.7 | 36.6 | 37.3 | 1.1 | 1.23 | 0.95 | 1.25 | 0.30 | 42 | 12.0 | Comparative example |

TABLE 11-continued

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite grain size (size No.) | Remark |
|---|---|---|---|---|---|---|---|---|---|---|---|---|---|---|---|---|---|---|---|
| 57 | 390 | 384 | 378 | 12 | 490 | 500 | 497 | 10 | 28.8 | 24.9 | 29.4 | 4.5 | 1.16 | 0.89 | 1.20 | 0.31 | 55 | 10.9 | Comparative example |
| 58 | 372 | 385 | 390 | 18 | 480 | 487 | 493 | 13 | 35.4 | 33.7 | 36.5 | 2.8 | 0.88 | 1.19 | 0.91 | 0.31 | 53 | 11.3 | Comparative example |
| 59 | 405 | 401 | 410 | 9 | 510 | 506 | 513 | 7 | 35.1 | 37.0 | 36.6 | 1.9 | 1.01 | 1.27 | 0.94 | 0.33 | 52 | 11.4 | Comparative example |
| 60 | 383 | 386 | 376 | 10 | 504 | 501 | 506 | 5 | 37.5 | 36.9 | 36.4 | 1.1 | 1.18 | 0.94 | 1.29 | 0.35 | 45 | 11.7 | Comparative example |
| 61 | 387 | 389 | 378 | 11 | 503 | 501 | 507 | 6 | 37.3 | 36.6 | 36.0 | 1.3 | 1.16 | 1.00 | 1.45 | 0.45 | 44 | 11.9 | Comparative example |
| 62 | 410 | 404 | 417 | 13 | 513 | 507 | 515 | 8 | 35.3 | 36.7 | 36.1 | 1.4 | 0.87 | 1.17 | 0.88 | 0.29 | 56 | 9.9 | Comparative example |
| 63 | 411 | 406 | 415 | 9 | 515 | 511 | 515 | 8 | 35.1 | 38.5 | 36.0 | 1.4 | 1.02 | 1.32 | 1.00 | 0.32 | 57 | 9.4 | Comparative example |
| 64 | 323 | 335 | 322 | 13 | 510 | 519 | 513 | 9 | 36.1 | 34.1 | 35.5 | 2.0 | 1.10 | 0.93 | 1.35 | 0.40 | 43 | 12.0 | Comparative example |

TABLE 12

| Steel sheet | Integrated reflective intensity (222): Surface | ¼ thickness | ½ thickness | Δ max | Remark |
|---|---|---|---|---|---|
| 39 | 2.80 | 2.79 | 2.90 | 0.11 | Present invention |
| 40 | 2.85 | 2.92 | 3.00 | 0.15 | Present invention |
| 41 | 2.87 | 2.93 | 3.00 | 0.13 | Present invention |
| 42 | 2.72 | 2.80 | 2.84 | 0.12 | Present invention |
| 43 | 2.54 | 2.60 | 2.66 | 0.12 | Present invention |
| 44 | 2.85 | 2.93 | 2.99 | 0.14 | Present invention |
| 45 | 2.88 | 3.01 | 2.95 | 0.13 | Present invention |
| 46 | 2.75 | 2.90 | 3.03 | 0.28 | Present invention |
| 47 | 2.77 | 3.06 | 2.98 | 0.29 | Present invention |
| 48 | 2.79 | 2.74 | 3.02 | 0.28 | Present invention |
| 49 | 2.65 | 2.77 | 2.90 | 0.25 | Present invention |
| 50 | 2.48 | 2.58 | 2.75 | 0.27 | Present invention |
| 51 | 2.80 | 3.02 | 2.97 | 0.22 | Present invention |
| 52 | 2.83 | 2.80 | 3.04 | 0.24 | Present invention |
| 53 | 2.81 | 2.88 | 2.96 | 0.15 | Comparative example |
| 54 | 2.84 | 2.87 | 2.98 | 0.14 | Comparative example |
| 55 | 2.90 | 3.04 | 2.99 | 0.14 | Comparative example |
| 56 | 2.20 | 2.28 | 2.32 | 0.12 | Comparative example |
| 57 | 2.82 | 2.93 | 2.91 | 0.11 | Comparative example |
| 58 | 2.83 | 2.90 | 2.98 | 0.15 | Comparative example |
| 59 | 2.73 | 2.79 | 2.86 | 0.13 | Comparative example |
| 60 | 2.85 | 2.92 | 3.00 | 0.15 | Comparative example |
| 61 | 2.82 | 2.96 | 2.93 | 0.14 | Comparative example |
| 62 | 2.38 | 2.42 | 2.53 | 0.15 | Comparative example |
| 63 | 2.83 | 2.88 | 2.96 | 0.13 | Comparative example |
| 64 | 2.33 | 2.39 | 2.48 | 0.15 | Comparative example |

Example 5

By making a slab containing the chemical composition specified by S65C-CSP of JIS G 4802 (by wt %, C: 0.65%, Si: 0.19%, Mn: 0.73%, P: 0.011%, S: 0.002% and Al: 0.020%) through a continuous casting process, reheating to 1100° C., hot rolling, coiling, primarily annealing, cold rolling, secondarily annealing, under the conditions shown in Tables 13 and 14, and temper rolling at a reduction rate of 1.5%, the steel sheets 65–90 of 2.5 mm thickness were produced. In this example, the reheating of sheet bar was conducted for some steel sheets. Herein, the steel sheet 90 is a conventional high carbon steel sheet. The same measurements as in Example 4 were conducted.

The results are shown in Tables 13–17.

As to the inventive steel sheets 65–78, the existing condition of carbides is within the range of the present invention, and therefore the HRc after quenching is above 50 and the good hardenability is obtained. The austenite grain size of these steel sheets is small, and therefore the excellent toughness is obtained. In addition, the Δmax of r-value is below 0.2, that is, the planar anisotropy is extremely small, and accordingly the forming is carried out with a high dimensional precision. At the same time, the Δmax of yield strength and tensile strength is 15 MPa or lower, the Δmax of the total elongation is 1.5% or lower, and thus each planar anisotropy is very small. In particular, the steel sheets 65–71 of which the sheet bar was reheated have small Δmax of (222) intensity in the thickness direction, and therefore more uniformed structure in the thickness direction.

In contrast, the comparative steel sheets 79–90 have large Δmax of the mechanical properties. The steel sheets 79, 81 and 88 have coarse austenite grain size. In the steel sheet 80, the HRc is less than 50.

TABLE 13

| Steel sheet | Reheating of sheet bar (° C. × sec) | Coiling temperature (° C.) | Primary annealing (° C. × hr) | Cold reduction rate (%) | Secondary annealing (° C. × hr) | Secondary annealing range by the formula (l) | Number of carbides larger than 1.5 μm | Ratio of carbides smaller than 0.6 μm (%) | Remark |
|---|---|---|---|---|---|---|---|---|---|
| 65 | 1050 × 15 | 580 | 640 × 40 | 70 | 680 × 40 | 632–680 | 85 | 87 | Present invention |
| 66 | 1100 × 3 | 530 | 640 × 20 | 60 | 680 × 40 | 632–680 | 82 | 88 | Present invention |
| 67 | 950 × 3 | 595 | 640 × 40 | 60 | 680 × 20 | 632–680 | 94 | 82 | Present invention |
| 68 | 1050 × 15 | 560 | 660 × 40 | 60 | 660 × 40 | 620–680 | 89 | 84 | Present invention |
| 69 | 1050 × 15 | 560 | 680 × 20 | 60 | 640 × 40 | 620–666 | 91 | 83 | Present invention |
| 70 | 1050 × 15 | 560 | 640 × 40 | 50 | 660 × 40 | 632–680 | 87 | 85 | Present invention |
| 71 | 1050 × 15 | 560 | 640 × 40 | 70 | 640 × 40 | 632–680 | 83 | 86 | Present invention |
| 72 | — | 560 | 640 × 40 | 70 | 680 × 40 | 632–680 | 86 | 86 | Present invention |
| 73 | — | 530 | 640 × 20 | 60 | 680 × 40 | 632–680 | 83 | 87 | Present invention |
| 74 | — | 595 | 640 × 40 | 60 | 680 × 20 | 632–680 | 94 | 82 | Present invention |
| 75 | — | 560 | 660 × 40 | 60 | 660 × 40 | 620–680 | 90 | 83 | Present invention |
| 76 | — | 560 | 680 × 20 | 60 | 640 × 40 | 620–686 | 92 | 83 | Present invention |
| 77 | — | 560 | 640 × 40 | 50 | 660 × 40 | 632–680 | 87 | 85 | Present invention |

TABLE 14

| Steel sheet | Reheating of sheet bar (° C. × sec) | Coiling temperature (° C.) | Primary annealing (° C. × hr) | Cold reduction rate (%) | Secondary annealing (° C. × hr) | Secondary annealing range by the formula (l) | Number of carbides larger than 1.5 μm | Ratio of carbides smaller than 0.6 μm (%) | Remark |
|---|---|---|---|---|---|---|---|---|---|
| 78 | — | 560 | 640 × 40 | 70 | 640 × 40 | 632–680 | 84 | 85 | Present invention |
| 79 | 1050 × 15 | 510 | 640 × 20 | 60 | 680 × 40 | 632–680 | 44 | 93 | Comparative example |
| 80 | 1100 × 3 | 610 | 640 × 20 | 60 | 680 × 20 | 632–680 | 100 | 62 | Comparative example |
| 81 | 950 × 3 | 560 | 620 × 40 | 60 | 680 × 40 | — | 47 | 90 | Comparative example |
| 82 | 1050 × 15 | 560 | 720 × 40 | 60 | 680 × 40 | — | 100 | 64 | Comparative example |
| 83 | 1050 × 15 | 560 | 640 × 15 | 70 | 680 × 40 | 632–680 | 84 | 87 | Comparative example |
| 84 | 1050 × 15 | 560 | 640 × 40 | 30 | 680 × 40 | 632–680 | 88 | 85 | Comparative example |
| 85 | 1050 × 15 | 560 | 660 × 20 | 60 | 610 × 40 | 620–680 | 89 | 84 | Comparative example |
| 86 | 1050 × 15 | 560 | 640 × 20 | 60 | 700 × 40 | 632–680 | 98 | 73 | Comparative example |
| 87 | 1050 × 15 | 560 | 640 × 40 | 60 | 690 × 40 | 632–680 | 98 | 70 | Comparative example |
| 88 | 1050 × 15 | 560 | 690 × 40 | 60 | 615 × 40 | 620–680 | 49 | 89 | Comparative example |
| 89 | 1050 × 15 | 600 | 690 × 20 | 50 | 650 × 40 | 632–680 | 96 | 77 | Comparative example |
| 90 | 1050 × 15 | 610 | — | 50 | 690 × 40 | — | 99 | 71 | Comparative example |

TABLE 15

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite Grain size (size No.) | Remark |
|---|---|---|---|---|---|---|---|---|---|---|---|---|---|---|---|---|---|---|---|
| 65 | 412 | 406 | 412 | 6 | 515 | 518 | 521 | 6 | 34.7 | 35.7 | 35.2 | 1.0 | 1.04 | 0.96 | 0.98 | 0.08 | 64 | 11.1 | Present invention |
| 66 | 422 | 419 | 424 | 5 | 523 | 521 | 526 | 5 | 35.1 | 36.0 | 35.1 | 0.9 | 0.98 | 1.02 | 1.06 | 0.08 | 64 | 11.0 | Present invention |
| 67 | 364 | 360 | 363 | 4 | 480 | 483 | 481 | 3 | 34.5 | 35.0 | 34.3 | 0.7 | 0.97 | 0.99 | 1.07 | 0.10 | 60 | 11.7 | Present invention |
| 68 | 409 | 409 | 415 | 6 | 517 | 514 | 519 | 5 | 34.7 | 35.7 | 34.7 | 1.0 | 1.02 | 0.96 | 0.93 | 0.09 | 62 | 11.5 | Present invention |
| 69 | 405 | 410 | 412 | 7 | 511 | 511 | 512 | 1 | 35.8 | 36.0 | 36.2 | 0.4 | 0.92 | 1.06 | 0.94 | 0.14 | 61 | 11.5 | Present invention |
| 70 | 416 | 412 | 421 | 9 | 520 | 517 | 523 | 6 | 35.9 | 36.0 | 36.7 | 0.8 | 0.89 | 1.03 | 0.96 | 0.14 | 62 | 11.4 | Present invention |
| 71 | 417 | 414 | 421 | 7 | 521 | 515 | 521 | 6 | 33.9 | 34.9 | 34.7 | 1.0 | 1.00 | 1.12 | 0.98 | 0.14 | 63 | 11.1 | Present invention |
| 72 | 411 | 406 | 413 | 7 | 515 | 519 | 523 | 8 | 34.2 | 35.7 | 35.3 | 1.5 | 1.08 | 0.93 | 0.97 | 0.15 | 63 | 11.2 | Present invention |
| 73 | 423 | 419 | 427 | 8 | 523 | 521 | 526 | 5 | 35.3 | 36.0 | 34.6 | 1.4 | 0.94 | 1.00 | 1.10 | 0.16 | 63 | 11.1 | Present invention |
| 74 | 365 | 360 | 362 | 5 | 479 | 483 | 480 | 4 | 34.6 | 35.0 | 34.1 | 0.9 | 0.95 | 0.98 | 1.12 | 0.17 | 60 | 11.7 | Present invention |
| 75 | 410 | 409 | 416 | 7 | 517 | 514 | 519 | 5 | 34.6 | 35.7 | 34.2 | 1.5 | 1.07 | 0.97 | 0.91 | 0.16 | 61 | 11.6 | Present invention |
| 76 | 405 | 408 | 415 | 10 | 511 | 512 | 514 | 3 | 35.4 | 36.1 | 36.6 | 1.2 | 0.92 | 1.11 | 0.95 | 0.19 | 60 | 11.6 | Present invention |
| 77 | 417 | 412 | 423 | 11 | 518 | 517 | 523 | 6 | 35.4 | 36.1 | 36.7 | 1.3 | 0.89 | 1.07 | 0.95 | 0.18 | 62 | 11.4 | Present invention |

TABLE 16

| Steel sheet | Mechanical properties before quenching: Yield strength (MPa) L | S | C | Δmax | Tensile strength (MPa) L | S | C | Δmax | Total elongation (%) L | S | C | Δmax | r-value L | S | C | Δmax | Hardness after quenching (HRc) | Austenite grain size (size No.) | Remark |
|---|---|---|---|---|---|---|---|---|---|---|---|---|---|---|---|---|---|---|---|
| 78 | 418 | 414 | 424 | 10 | 520 | 515 | 524 | 9 | 33.4 | 34.9 | 34.5 | 1.5 | 1.00 | 1.17 | 0.98 | 0.19 | 62 | 11.2 | Present invention |
| 79 | 385 | 380 | 390 | 10 | 518 | 515 | 520 | 5 | 28.0 | 24.8 | 28.2 | 3.4 | 1.18 | 0.92 | 1.25 | 0.33 | 66 | 8.4 | Comparative example |
| 80 | 385 | 400 | 394 | 15 | 489 | 500 | 494 | 11 | 25.7 | 23.2 | 25.0 | 2.5 | 1.12 | 0.88 | 1.22 | 0.34 | 49 | 12.2 | Comparative example |
| 81 | 406 | 410 | 415 | 9 | 519 | 522 | 526 | 7 | 25.3 | 24.0 | 26.7 | 2.7 | 1.18 | 1.01 | 1.42 | 0.41 | 66 | 9.1 | Comparative example |
| 82 | 384 | 397 | 392 | 13 | 492 | 500 | 497 | 8 | 35.8 | 34.3 | 35.6 | 1.5 | 1.18 | 0.93 | 1.32 | 0.39 | 50 | 12.1 | Comparative example |

TABLE 16-continued

| Steel | Mechanical properties before quenching | | | | | | | | | | | | | | | | Hardness after quenching | Austetine grain size | |
|---|---|---|---|---|---|---|---|---|---|---|---|---|---|---|---|---|---|---|---|
| | Yield strength (MPa) | | | | Tensile strength (MPa) | | | | Total elongation (%) | | | | r-value | | | | | | |
| sheet | L | S | C | Δmax | L | S | C | Δmax | L | S | C | Δmax | L | S | C | Δmax | (HRc) | (size No.) | Remark |
| 83 | 405 | 397 | 389 | 16 | 500 | 509 | 511 | 11 | 27.0 | 22.4 | 27.4 | 5.0 | 1.24 | 0.90 | 1.27 | 0.37 | 63 | 11.1 | Comparative example |
| 84 | 386 | 398 | 406 | 20 | 486 | 496 | 503 | 17 | 33.4 | 31.9 | 34.8 | 2.9 | 0.81 | 1.16 | 0.93 | 0.35 | 62 | 11.4 | Comparative example |
| 85 | 418 | 412 | 425 | 13 | 521 | 516 | 524 | 8 | 33.2 | 35.1 | 34.5 | 1.9 | 1.02 | 1.23 | 0.86 | 0.37 | 61 | 11.5 | Comparative example |
| 86 | 402 | 393 | 388 | 14 | 512 | 509 | 515 | 6 | 35.7 | 34.9 | 34.3 | 1.4 | 1.24 | 0.95 | 1.25 | 0.30 | 53 | 11.8 | Comparative example |
| 87 | 406 | 395 | 394 | 12 | 514 | 510 | 517 | 7 | 35.5 | 34.7 | 34.1 | 1.4 | 1.11 | 0.86 | 1.19 | 0.33 | 52 | 12.0 | Comparative example |
| 88 | 421 | 417 | 431 | 14 | 523 | 518 | 525 | 7 | 33.3 | 34.8 | 34.3 | 1.5 | 1.00 | 1.26 | 0.92 | 0.34 | 65 | 10.0 | Comparative example |
| 89 | 375 | 363 | 369 | 12 | 482 | 490 | 486 | 8 | 34.3 | 35.4 | 34.0 | 1.4 | 1.17 | 0.99 | 1.40 | 0.41 | 58 | 11.8 | Comparative example |
| 90 | 338 | 350 | 331 | 19 | 517 | 528 | 524 | 11 | 34.5 | 32.4 | 33.6 | 2.1 | 1.13 | 0.83 | 1.29 | 0.42 | 54 | 11.9 | Comparative example |

TABLE 17

| Steel sheet | Integrated reflective intensity (222) | | | | Remark |
|---|---|---|---|---|---|
| | Surface | ¼ thickness | ½ thickness | Δ max | |
| 65 | 2.87 | 2.82 | 2.97 | 0.15 | Present invention |
| 68 | 2.83 | 2.86 | 2.94 | 0.11 | Present invention |
| 67 | 2.85 | 2.90 | 2.97 | 0.12 | Present invention |
| 68 | 2.75 | 2.81 | 2.86 | 0.11 | Present invention |
| 69 | 2.58 | 2.64 | 2.71 | 0.13 | Present invention |
| 70 | 2.84 | 2.91 | 2.96 | 0.12 | Present invention |
| 71 | 2.85 | 2.99 | 2.95 | 0.14 | Present invention |
| 72 | 2.73 | 2.85 | 3.02 | 0.29 | Present invention |
| 73 | 2.76 | 3.03 | 2.97 | 0.27 | Present invention |
| 74 | 2.78 | 2.92 | 3.04 | 0.26 | Present invention |
| 75 | 2.69 | 2.82 | 2.96 | 0.27 | Present invention |
| 76 | 2.50 | 2.64 | 2.75 | 0.25 | Present invention |
| 77 | 2.81 | 3.03 | 2.99 | 0.22 | Present invention |
| 78 | 2.79 | 2.87 | 3.03 | 0.24 | Present invention |
| 79 | 2.83 | 2.87 | 2.96 | 0.13 | Comparative example |
| 80 | 2.84 | 2.88 | 2.99 | 0.15 | Comparative example |
| 81 | 2.92 | 3.03 | 2.95 | 0.11 | Comparative example |
| 82 | 2.22 | 2.26 | 2.34 | 0.12 | Comparative example |
| 83 | 2.85 | 2.97 | 2.92 | 0.12 | Comparative example |
| 84 | 2.88 | 2.94 | 3.02 | 0.14 | Comparative example |
| 85 | 2.73 | 2.75 | 2.87 | 0.14 | Comparative example |
| 86 | 2.84 | 2.87 | 2.99 | 0.15 | Comparative example |
| 87 | 2.86 | 3.01 | 2.92 | 0.15 | Comparative example |
| 88 | 2.40 | 2.42 | 2.54 | 0.14 | Comparative example |
| 89 | 2.89 | 2.98 | 3.04 | 0.15 | Comparative example |
| 90 | 2.37 | 2.40 | 2.50 | 0.13 | Comparative example |

The invention claimed is:

1. A method of producing a high carbon steel sheet, comprising the steps of:

hot rolling a steel having chemical composition specified by JIS G 4051, JIS G 4401 or JIS G 4802, coiling the hot rolled steel sheet at 520 to 600° C., descaling the coiled steel sheet, annealing the descaled steel sheet at 640 to 690° C. for 20 hr or longer (primary annealing), cold rolling the annealed steel sheet at a reduction rate of 50% or more, and annealing the cold rolled steel sheet at 620 to 680° C. (secondary annealing), and wherein the temperature T1 of the primary annealing and the temperature T2 of the secondary annealing satisfy the following formula (1), $$1024-0.6\times T1 \leqq T2 \leqq 1202-0.80\times T1 \ldots \quad (1).$$

2. A method of producing a high carbon steel sheet, comprising the steps of:

continuously casting into slab a steel having chemical composition specified by JIS G 4051, JIS G 4401 or JIS G 4802, rough rolling the slab to sheet bar without reheating the slab or after reheating the slab cooled to a certain temperature, finish rolling the sheet bar after reheating the sheet bar to Ar3 transformation point or higher, coiling the finish rolled steel sheet at 500 to 650° C., descaling the coiled steel sheet, annealing the descaled steel sheet at a temperature T1 of 630 to 700° C. for 20 hr or longer (primary annealing), cold rolling the annealed steel sheet at a reduction rate of 50% or higher, and annealing the cold rolled steel sheet at a temperature T2 of 620 to 680° C. (secondary annealing), wherein the temperature T1 and the temperature T2 satisfy the following formula (2), $$1010-0.59\times T1 \leqq T2 \leqq 1210-0.80\times T1 \ldots \quad (2).$$

3. A method of producing a high carbon steel sheet, comprising the steps of:

continuously casting into slab a steel having chemical composition specified by JIS G 4051, JIS G 4401 or JIS G 4802, rough rolling the slab to sheet bar without reheating the slab or after reheating the slab cooled to a certain temperature, finish rolling the sheet bar during reheating the rolled sheet bar to Ar3 transformation point or higher, coiling the finish roiled steel sheet at 500 to 650° C., descaling the coiled steel sheet, annealing the descaled steel sheet at a temperature T1 of 630 to 700° C. for 20 hr or longer (primary annealing), cold rolling the annealed steel sheet at a reduction rate of 50% or higher, and annealing the cold rolled steel sheet at a temperature T2 of 620 to 680° C. (secondary annealing), wherein the temperature T1 and the temperature T2 satisfy the following formula (2)

$$1010-0.59\times T1 \leqq T2 \leqq 1210-0.80\times T1 \quad \ldots \quad (2).$$

* * * * *